United States Patent [19]

McNair

[11] 4,058,062

[45] Nov. 15, 1977

[54] POWERHEAD CARTRIDGE

[75] Inventor: Rhett McNair, Honolulu, Hawaii

[73] Assignee: Aqua Craft, Inc., San Diego, Calif.

[21] Appl. No.: 779,910

[22] Filed: Mar. 21, 1977

Related U.S. Application Data

[60] Division of Ser. No. 581,660, May 28, 1975, abandoned, which is a continuation of Ser. No. 381,593, July 23, 1973, abandoned, which is a continuation-in-part of Ser. No. 98,354, Dec. 17, 1970, Pat. No. 3,747,247.

[51] Int. Cl.[2] ..... F42B 5/02

[52] U.S. Cl. ..... 102/38; 102/92.1

[58] Field of Search ..... 102/38, 43, 92.1–92.7, 102/48, 53; 42/1 L

[56] References Cited

U.S. PATENT DOCUMENTS

| | | | |
|---|---|---|---|
| 320,393 | 6/1885 | Pierce | 102/48 |
| 1,899,618 | 2/1933 | Holthe | 102/38 |
| 2,708,860 | 5/1955 | Arpin | 102/48 X |
| 2,918,002 | 12/1959 | Pons | 102/43 |
| 3,157,126 | 11/1964 | Blondeau | 102/93 X |
| 3,274,936 | 9/1966 | Messina et al. | 102/48 |
| 3,300,888 | 1/1967 | Belcher et al. | 42/1 L |
| 3,613,584 | 10/1971 | Hendricks | 102/48 |
| 3,618,244 | 11/1971 | Johnson | 102/38 |
| 3,621,781 | 11/1971 | Johnsen | 102/38 |

FOREIGN PATENT DOCUMENTS

| | | | |
|---|---|---|---|
| 3,967 of | 1903 | United Kingdom | 102/38 |

OTHER PUBLICATIONS

Blondeau Publication, Mar. 1966.

*Primary Examiner*—Harold Tudor
*Attorney, Agent, or Firm*—James C. Wray

[57] ABSTRACT

A 30-30 casing has sharpened rings formed in its enlarged base. Powder is packed in the casing, and it is sealed by inserting a primer portion, which is a 38 caliber pistol shell with a primer, in the open end of the packed casing and compressing the edge of the casing in the base area of the primer portion.

Radial extensions on the casing hold the cartridge centered in a barrel spaced from a firing pin.

The primer is ignited by hitting the sharpened rings against an underwater object and thus driving the cartridge and primer rearward against a fixed firing pin. The casing rockets forward out of the barrel, leaving the primer piece and smashing into the underwater object while the powder burns.

8 Claims, 14 Drawing Figures

FIG. 2
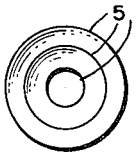
FIG. 1
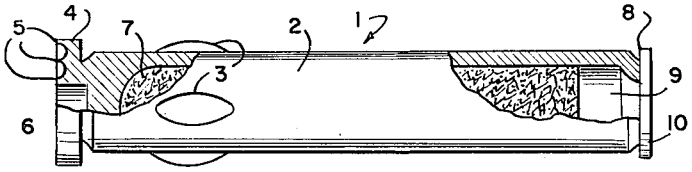
FIG. 3
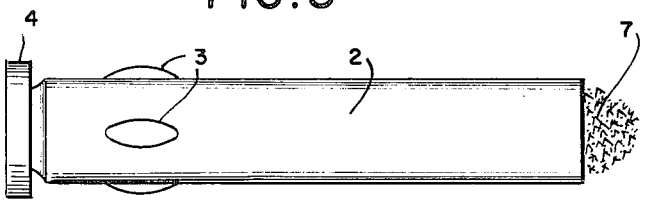
FIG. 4
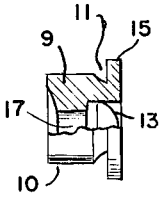
FIG. 5
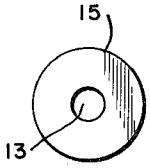
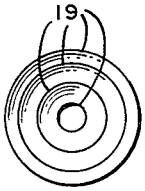
FIG. 7
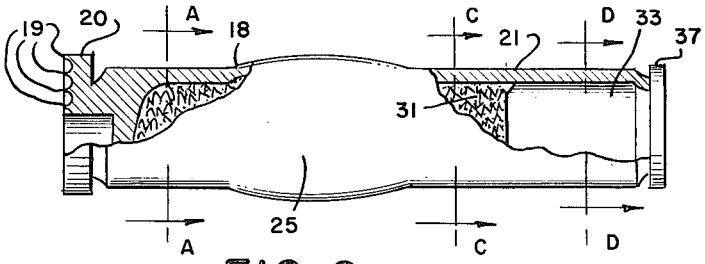
FIG. 6
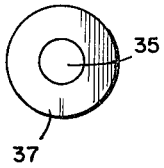
FIG. 9
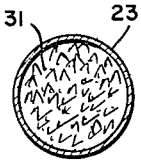
FIG. 11A
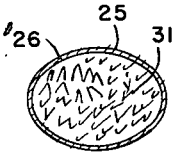
FIG. 11B
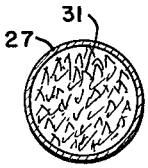
FIG. 11C
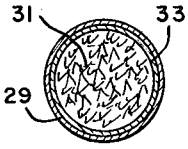
FIG. 11D
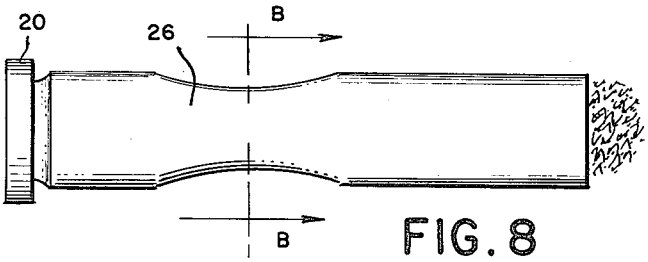
FIG. 8
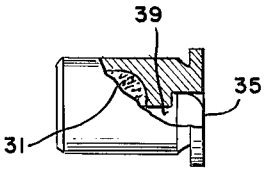
FIG. 10

POWERHEAD CARTRIDGE

This is a division of application Ser. No. 581,660 filed May 28, 1975, now abandoned; which is a continuation of Ser. No. 381,593 filed July 23, 1973, now abandoned; which is a continuation in part of Ser. No. 98,354, filed Dec. 17, 1970 now U.S. Pat. No. 3,747,247.

SUMMARY OF THE INVENTION

This invention relates to a firearm cartridge device or weapon or an explosive working device which has a special use in underwater operations, for instance in the sea for killing sharks and other kinds of dangerous fish. Swimming persons, divers and undersea explorers and undersea workers can use this invention and find it a great aid, not only as a weapon for defense but also as a useful tool for small demolition work etc. A powerhead device is provided that can easily puncture a target.

the weapon has advantages over other types and kinds of powerheads. For instance, it can be easily and speedily reloaded in that only one or two seconds is required for the reloading rather than twenty seconds or more generally required by present known weapons for undersea operations. The cartridge in applicant's device is muzzle loaded instead of breech loaded, as in common undersea weapons. The device is simple and dependable in operation because it has no moving parts, and furthermore, the weapon is not subject to jamming because of corrosion and/or mineral deposits. Therefore, a clear space tolerance is maintained at all times between the cartridge and the bore or the wall of the firing chamber.

Because of the unique design of the forward casing head, the weapon fires easily at various angles with respect to the target. The cartridge digs into the surface of the target. In this invention the cartridge is in fact a rocket. The entire cartridge is a projectile and acts in a manner similar to a bullet from ordinary firearms in addition to being a rocket.

A principal object of this invention is to present an effective firearm cartridge which has a head that can enter into the surface of a target in water, and which is designed and constructed so that it is economical to make and manufacture.

Another object of the invention is to provide a combination projectile which can be used manually and wherein the striking of the projectile upon the target causes the projectile to expiode and thus shoot from the firing chamber with great force.

Still another object is to provide a rocket-like device which can be shot from a rifle-like means, a bow, or a bow type rifle means employing an elastic.

Other objects will become apparent upon careful reading of the specification and the drawings, which are part and parcel hereof.

A powerhead is usually attached to a suitable pole or rod or shaft of 4 or 5 feet in length, and the entire unit is carried by the swimmer, or diver as a defense against sharks. The weapon is carried unloaded until such time as it is needed. Upon seeing the need to fire the weapon, the swimmer or diver inserts a cartridge into the bore from the muzzle end to a position spaced from a fixed firing pin. When the forward end of the weapon is jabbed against a target, the protruding head of the cartridge strikes the surface of the target and forces the cartridge to quickly slide down into the bore and hit against the firing pin with sufficient impact to detonate the primer. This action ignites the gun powder and fires the cartridge. The main body of the cartridge then becomes a projectile and penetrates the surface of the target.

An open channel and the multiple holes between an inner shoulder in a barrel and a firing pin which projects above the shoulder provide for rapid displacement of water from the bore at the firing chamber. This construction allows the cartridge to move toward the firing pin rapidly enough to furnish the necessary impact to detonate the primer, when the loaded weapon is thrust against the surface of a target. At the instant of firing, the rapidly expanding gasses within the cartridge separate the two main parts of the cartridge and propel them in opposite directions.

The protruding point of the firing pin impresses itself into the primer, and the rim of the primer-piece seats itself on the shoulder at the base of the firing chamber. This in effect seals off the lower end of the bore and thus causes the gas expansion to find exit through the muzzle end of the weapon. The remaining primer-piece is then removed from the bore by implosion and the water suction which follows the main cartridge. A clear tolerance of space is allowed for this purpose. The weapon may be reloaded simply by inserting another cartridge into the bore from the muzzle end.

The design of the weapon utilizes the non-comressibility of water as a means to allow for a clear tolerance between the cartridge and the walls of the bore, making possible the very rapid muzzle loading. Since loading is made only underwater, the space between the cartridge and the wall of the bore is filled with water. Since water is incompressible, the lateral restriction offered by the walls of the bore is extended to the walls of the cartridge by means of the intervening water; thus a negligible amount of power is lost as a result of the relatively large tolerance.

The sharp rings at the muzzle end of the cartridge head allow the cartridge head to strike a target with full impact at angles up to 45° and beyond. The annular grooves and the resultant sharp protruding rings which have been machined into the head are effective by digging into the surface and preventing slippage.

The powerhead is made of stainless steel or some other non-corrosive material. The cartridge is made of conventional brass parts. The main body and the primerpiece are separated when fired. The body in its present form is a modified version of the well known 30-30 cartridge case and which has been taken from the manufacturer's assembly line before it is punched through for the firing hole at the primer end and the opposite end necked down to fit a bullet. The annular sharp grooves are then turned into the rim end. The casing is deformed centrally to partially engage the barrel wall. Alternatively, silicone, or other elastic or rubber-like lumps bonded or taped to sides of the cartridge serve to hold the cartridge in position in the firing chamber while allowing it to slide back rapidly upon impact with a target. These resilient lumps also serve to automatically space the cartridge primer a sufficient distance from the firing pin point to allow the necessary travel of the cartridge to achieve maximum impact. This spacing is achieved by pushing the cartridge down to make light contact with the firing pin. When the cartridge is released, the silicone surface which has been angled away from the firing pin because of pressure upon its resilient surfaces will then rebound to the original positions and thus push the cartridge away from the firing pin to form the needed space for firing movement.

the primer-piece is a modification of the well known 38 caliber pistol cartridge casing and primer.

The main body of the cartridge is filled with gunpowder and then is joined with the primer-piece in a manner which renders it waterproof at great depths and pressures. In its present form, this is achieved by sealing the two pieces together with epoxy or other suitable adhesives and by crimping the lower end of the main body into the annular groove at the base of the primer-piece. The primer is also sealed into the primer-piece with a suitable adhesive.

BRIEF DESCRIPTION OF THE DRAWINGS

FIG. 1 is a partially cutaway elevation of a cartridge of the present invention.

FIG. 2 is a head end view showing sharpened rings.

FIG. 3 is an elevation of the rocketing head shown in FIG. 1.

FIG. 4 is a detail of the separated primer piece, partially shown in FIG. 1. FIG. 5 is a primer end view of the cartridge. FIG. 6 is a partially cutaway elevation of a preferred embodiment of the invention. FIG. 7 is a head end view of the cartridge shown in FIG. 6. FIG. 8 is an elevation of the explosion-separated head of the cartridge of FIG. 6.

FIG. 9 is a primer end view of the FIG. 6 cartridge. FIG. 10 is a partially cutaway detail of the primer piece of the FIG. 6 embodiment. FIGS. 11A–11D are a series of cross sections of the cartridge shown in FIG. 6 taken along the indicated lines.

DETAILED DESCRIPTION OF THE DRAWINGS

Referring to FIG. 1 a powerhead cartridge is generally indicated by the numeral 1. A relatively long cylindrical wall 2 supports spaced resilient knobs 3 for centering the cartridge in a powerhead barrel. An enlarged head 4 is integrally formed on wall 2. Grooves 5 shown in FIG. 2 are cut in the head for digging into a target surface such as tough shark skin. A central recess 6 provides the primer location in a conventional cartridge. However, the head and wall in the present cartridge are formed from a blank 30-30 casing before a primer hole is completely drilled through the end.

Powder 7 is packed into the cartridge before primer piece 10 is joined with wall 2 by closely fitting short cylindrical wall 9 within wall 2 and necking in edge 8.

FIG. 3 illustrates the casing immediately after firing. Burned powder 7 explodes from the open end of the head piece, separating the head piece from the primer piece 10 shown in FIG. 4. As is conventional in 38 caliber ammunition, a recess 11 is formed at a junction of wall 9 and end 15. Edge 8 of head piece wall 2 is shrunk into recess 11 as shown in FIG. 1 to tightly seal the two pieces.

A primer 13 fits tightly in a center recess of base 15, and bore 17 provides access between primer 13 and powder 7.

In the preferred form of the invention shown in FIGS. 6 through 11, the cartridge is generally indicated by the numeral 18. Four sharpened rings 19 are provided in head 20 to dig into a target for ensuring the driving of the cartridge 18 against a firing pin with sufficient force to fire the cartridge and for ensuring the entering of the body of the target by the cartridge head.

The relatively long cylindrical wall 21 has a cylindrical section 23 close to head 20. A forward central portion 25 is squashed to create radially extending ridges 26, which hold the cartridge centered in a barrel of a powerhead. Rearward sections 27 and 29 are cylindrical.

The integrally formed cylindrical wall 21 of the main casing is necked down at its open end to tightly seal the wall around the recess between wall 33 and base 37 of the primer piece.

Wall section 29 fits closely over wall 33 of primer piece to complete the sealing.

A primer 35 is held within a central recess of base 37, and bore 39 provides access between the primer and powder 31 packed within cylindrical walls 33 and 21.

As primer 35 is fired, powder 31 begins burning and separates the pieces. The primer piece is thrust rearward against its seat sealing the bore, and the main cartridge is rocketed outward driving into the target as the burning continues.

While the invention has been described in part with reference to specific embodiments, it is obvious to those skilled in the art that modifications and variations may be constructed without departing from the spirit and scope of the invention. The scope of the invention is defined in the following claims.

I claim:

1. Underwater powerhead firearm apparatus comprising a cartridge having a head piece and a base primer piece, wherein the head piece comprises a rifle cartridge casing blank having a cylindrical wall joined integrally with an impervious flat, radially extending head, propellant powder within the cylindrical wall, and wherein the primer piece comprises a cartridge casing having a relatively short cylindrical wall inserted within an open end of the rifle cartridge casing, an integrally formed base joined with the short cylindrical wall, and a primer inserted in the base for firing into powder disposed within the cylindrical wall, an open end edge of the rifle casing being necked down around a joint of the base and small cylindrical wall, tightly sealing the cartridge.

2. The apparatus of claim 1 further comprising means on the head for facilitating gripping of a target surface upon striking a target surface, and wherein the head extends radially outward from the cylindrical wall.

3. The apparatus of claim 1 wherein the base comprises a relatively short cylindrical wall extending toward the head and wherein an end of the head-attached cylindrical wall surrounds the base cylindrical wall.

4. The apparatus of claim 1 further comprising resilient means extending outward from the cylindrical wall intermediate the head and the base, for holding the cylindrical wall spaced from a barrel.

5. The apparatus of claim 1 wherein the cartridge casing is a 30-30 casing blank and the pistol cartridge casing is a 38 casing with primer.

6. The apparatus of claim 1 wherein the rifle cartridge casing cylindrical wall is partially radially extended for holding the cartridge in a barrel.

7. The apparatus of claim 1 wherein the head has sharpened annular rings machined in said flat head thereof for digging into a surface of a target.

8. The apparatus of claim 1 wherein the cartridge is sealed against high pressure water ingress.

* * * * *